US010030289B2

(12) United States Patent
Jung et al.

(10) Patent No.: US 10,030,289 B2
(45) Date of Patent: Jul. 24, 2018

(54) SPHEROIDAL GRAPHITE CAST IRON FOR AN ENGINE EXHAUST SYSTEM

(71) Applicant: Doosan Infracore Co., Ltd., Incheon (KR)

(72) Inventors: Ki-Hwan Jung, Gyeonggi-do (KR); Young-Kyu Ju, Seoul (KR); Jong-Kwon Chung, Gyeonggi-do (KR); Jae-Hyoung Hwang, Gyeonggi-do (KR); Sik Yang, Gyeonggi-do (KR); Dong-Seob Shim, Gyeonggi-do (KR); Sang-Beom Kim, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 110 days.

(21) Appl. No.: 15/120,651

(22) PCT Filed: Feb. 6, 2015

(86) PCT No.: PCT/KR2015/001255

§ 371 (c)(1),
(2) Date: Aug. 22, 2016

(87) PCT Pub. No.: WO2015/126083

PCT Pub. Date: Aug. 27, 2015

(65) Prior Publication Data

US 2017/0016098 A1 Jan. 19, 2017

(30) Foreign Application Priority Data

Feb. 21, 2014 (KR) ..... 10-2014-0020632

(51) Int. Cl.
*F01N 13/10* (2010.01)
*C22C 37/10* (2006.01)
(Continued)

(52) U.S. Cl.
CPC ..... *C22C 37/10* (2013.01); *C22C 37/04* (2013.01); *F01N 13/10* (2013.01); *F01N 13/16* (2013.01); *F01N 2510/08* (2013.01)

(58) Field of Classification Search
CPC ..... C22C 37/10; C22C 37/04; C22C 33/10; F01N 13/10; F01N 13/16; F01N 2510/08
(Continued)

(56) References Cited

U.S. PATENT DOCUMENTS 8,721,808 B2 5/2014 Yamanaka et al.
2004/0223866 A1* 11/2004 Kim ..... C22C 37/10 420/26

(Continued)

FOREIGN PATENT DOCUMENTS

CN 1572894 2/2005
CN 102301029 12/2011

(Continued)

OTHER PUBLICATIONS

International Search Report (with English translation) issued in international application No. PCT/KR2015/001255, dated May 22, 2015, 5 pages.

(Continued)

*Primary Examiner* — Laert Dounis
*Assistant Examiner* — Kelsey Stanek
(74) *Attorney, Agent, or Firm* — K&L Gates LLP

(57) ABSTRACT

A spheroidal graphite cast iron for a component of an engine exhaust system includes carbon ranging from about 3.0 wt % to about 3.4 wt %, silicon ranging from about 4.2 wt % to about 4.5 wt %, manganese ranging from about 0.1 wt % to about 0.3 wt %, sulfur ranging from about 0.002 wt % to about 0.01 wt %, phosphorous in a range equal to or less than about 0.05 wt %, magnesium ranging from about 0.035 wt % to about 0.055 wt %, molybdenum ranging from about 0.9 wt % to about 1.2 wt %, nickel ranging from about 0.2 wt % to about 0.5 wt %, vanadium ranging from about 0.4 wt % to about 0.6 wt %, niobium ranging from about 0.1 wt % to about 0.4 wt %, cerium ranging from about 0.005 wt % to about 0.01 wt %, aluminum ranging from about 0.003 wt % to about 0.007 wt %, and a remainder of iron.

9 Claims, 5 Drawing Sheets

(51) Int. Cl.
*C22C 37/04* (2006.01)
*F01N 13/16* (2010.01)

(58) Field of Classification Search
USPC ..... 60/324
See application file for complete search history.

(56) References Cited

U.S. PATENT DOCUMENTS

| | | | | |
|---|---|---|---|---|
| 2010/0178193 | A1* | 7/2010 | Zeipper | C22C 37/10 420/27 |
| 2011/0132499 | A1* | 6/2011 | Yamanaka | C22C 38/02 148/325 |

FOREIGN PATENT DOCUMENTS

| | | | | |
|---|---|---|---|---|
| JP | S5871377 | A | * | 4/1983 |
| JP | 2008-156688 | A | | 7/2008 |
| JP | 2008-303434 | A | | 12/2008 |
| KR | 10-2009-0132798 | A | | 12/2009 |
| KR | 10-2010-0015118 | A | | 2/2010 |
| KR | 10-2013-0130490 | A | | 12/2013 |

OTHER PUBLICATIONS

Written Opinion issued in international application No. PCT/KR2015/001255, dated May 22, 2015, 6 pages.
Office Action issued in related Chinese Patent Application No. 201580009785.1 dated Apr. 6, 2017. 7 pages.

* cited by examiner

SPHEROIDAL GRAPHITE CAST IRON FOR AN ENGINE EXHAUST SYSTEM

CROSS REFERENCE TO RELATED APPLICATIONS

The present application is a National Stage of International Application No. PCT/KR2015/001255, filed on Feb. 6, 2015, which claims priority to Korean Patent Application No. 10-2014-0020632, filed on Feb. 21, 2014, the entire contents of each of which are being incorporated herein by reference.

BACKGROUND

1. Field

The present inventive concepts relate to spheroidal graphite cast iron having improved oxidation-resistive property at a high temperature and fluidity, more particularly, at more than about 800° C. in an engine exhaust system.

2. Description of the Related Art

Recently, environment-related restrictions are becoming strengthened globally, and thus an amount of pollutants in an exhaust gas discharged from an engine should be reduced, and methods of achieving a high power from the same displacement volume are being developed. For this purpose, a combustion temperature may be increased by raising an explosion pressure of the engine. As the combustion temperature increases, an exhaust system component such as an exhaust manifold that may have an improved oxidation-resistive property may be needed.

Spheroidal graphite cast iron in which silicon (Si) and molybdenum (Mo) are added is used for the exhaust system component such as a conventional engine exhaust manifold. The spheroidal graphite cast iron is used as a material for the exhaust system component such as the engine exhaust manifold in which a temperature of an exhaust gas is less than about 800° C. However, as the explosion pressure becomes greater due to a high engine performance, the temperature of the exhaust gas may increase above about 800° C. If the exhaust system component is exposed to the exhaust gas having a temperature greater than about 800° C., an oxidized layer may be formed on a surface of the spheroidal graphite cast iron. Further, the oxidized layer may be decomposed due to an expansion coefficient difference, e.g., a coefficient of thermal expansion (CTE) between the oxidized layer and the spheroidal graphite cast iron, and an additional oxidized layer may be created between the decomposed oxidized layers to cause cracks. Accordingly, the conventional spheroidal graphite cast iron may be limited to be used for the exhaustion system component such as the engine exhaust manifold when the temperature of the exhaust gas increases above about 800° C. FIG. 1 shows an image of cracks formed in a material of an exhaust system component, and illustrates a crack formation mechanism. To overcome the problems as mentioned above, a spheroidal graphite cast iron that may be applied to an engine exhaust system component even at an exhaust gas temperature greater than about 800° C. are being developed by improving an oxidation-resistive property and a fluidity.

Adding an alloy element may be considered to overcome the problems. However, the fluidity may be degraded by the addition of the alloy element to cause a production failure when manufacturing the exhaust system manifold, e.g., a thin cast exhaust manifold.

SUMMARY

To overcome the problems as discussed above, the present inventive concepts provide a spheroidal graphite cast iron having improved oxidation-resistive property at a high temperature in an engine exhaust system component and fluidity.

According to example embodiments, nickel (Ni) and aluminum (Al) may be added to a conventional spheroidal graphite cast iron, and a weight ratio may be controlled in a specific range. For example, the weight ratio of nickel and aluminum (Ni/Al) in the spheroidal graphite cast iron may be controlled in a range from about 29 to about 166. In some embodiments, vanadium (V), niobium (Nb) and cerium (Ce) may be added to improve mechanical properties such as a high temperature tensile strength.

According to example embodiments as described above, the spheroidal graphite cast iron may have a thickness of a surface oxidized layer less than about 190 μm when thermally treated at a temperature less than about 900° C., may have a fluidity greater than about 750 mm, and may have a tensile strength at a high temperature (800° C.) greater than about 50 MPa. Thus, cracks at the high temperature may be reduced or prevented, and defects of an engine exhaust system may be also reduced.

BRIEF DESCRIPTION OF THE DRAWINGS

Example embodiments will be more clearly understood from the following detailed description taken in conjunction with the accompanying drawings which represent non-limiting, example embodiments as described herein.

DESCRIPTION OF EMBODIMENTS

Figure 1:
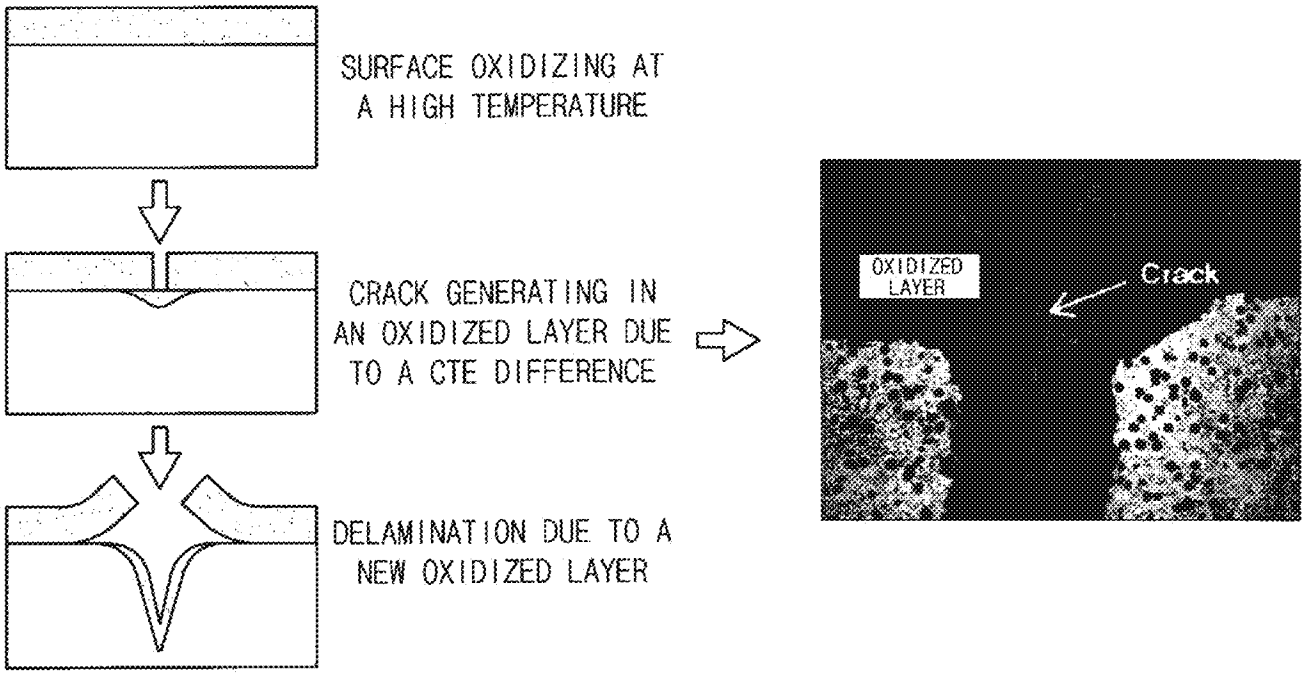
FIG. 1 illustrates a crack formed in a conventional exhaust system component, and a mechanism of the crack formation.

Various example embodiments will be described. The present inventive concept may, however, be embodied in many different forms and should not be construed as limited to the example embodiments set forth herein. Rather, these example embodiments are provided so that this description will be thorough and complete, and will fully convey the scope of the present inventive concept to those skilled in the art.

According to example embodiments of the present inventive concepts, a trace amount of aluminum (Al) may be used as an ingredient of a spheroidal graphite cast iron, and a content ratio of Ni and Al (Ni/Al) in the spheroidal graphite cast iron may be controlled in a specific range. Nickel (Ni) and aluminum (Al) which may have improved oxidation-resistive property may be reacted to form a dense oxidized layer on a surface of the spheroidal graphite cast iron at a high temperature. Aluminum (Al) may serve as a nucleation site of graphite to assist growth and crystallization of a spheroidal graphite, even when a facilitating element for creating carbide such as molybdenum (Mo), vanadium (V) or niobium (Nb) may be added. Thus, oxidation-resistive property at a high temperature and fluidity may be enhanced.

A content of Al, and the content ratio (Ni/Al) may be critical factor in manufacturing the spheroidal graphite cast iron having improved oxidation-resistive property and fluidity. In the spheroidal graphite cast iron, a thickness of the oxidized layer at a high temperature (e.g., about 900° C.) may be less than about 190 μm, a length of a helical specimen for evaluating a fluidity may be greater than about 750 mm, and a high temperature tensile strength (about 800° C.) may be greater than about 50 MPa. Thus, a chemical composition of the spheroidal graphite cast iron may be adjusted in an exemplary chemical composition as described below.

Hereinafter, methods of manufacturing the spheroidal graphite cast iron and the chemical composition of the spheroidal graphite cast iron will be described. However, the present inventive concepts are not limited to the methods described below, and stages or steps in each process may be properly modified by those ordinarily skilled in the art.

The spheroidal graphite cast iron according to example embodiments may include carbon (C) in a range from about 3.0 weight percent (wt %) to about 3.4 wt %, silicon (Si) in a range from about 4.2 wt % to about 4.5 wt %, manganese (Mn) in a range from about 0.1 to about 0.3 wt %, sulfur (S) in a range from about 0.002 wt % to about 0.01 wt %, phosphorous (P) equal to or less than about 0.05 wt %, magnesium (Mg) in a range from about 0.035 wt % to about 0.055 wt %, molybdenum (Mo) in a range from about 0.9 wt % to about 1.2 wt %, nickel (Ni) in a range from about 0.2 wt % to about 0.5 wt %, vanadium (V) in a range from about 0.4 wt % to about 0.6 wt %, niobium (Nb) in a range from about 0.1 wt % to about 0.4 wt %, cerium (Ce) in a range from about 0.005 wt % to about 0.01 wt %, aluminum (Al) in a range from about 0.003 wt % to about 0.007 wt %, and a remainder of iron (Fe), based on a total weight of the spheroidal graphite cast iron. Additionally, a content ratio of Ni and Al (Ni/Al) may be in a range from about 29 to about 166.

Hereinafter, each element contained in the spheroidal graphite cast iron and an amount of each element will be described in more detail.

1) Carbon (C) in a Range from about 3.0 wt % to about 3.4 wt %

Carbon may be an element for crystallizing a robust spheroidal graphite. Carbon may be required in the spheroidal graphite cast iron according to example embodiments for crystallizing the spheroidal graphite, forming a carbide to improve a high temperature strength and forming a fine pearlite. If an amount of carbon (C) is less than about 3.0 wt %, the number of the spheroidal graphite per unit area may be reduced to degrade a tensile strength at a room temperature and a high temperature. If an amount of carbon (C) exceeds about 3.4 wt %, a primary graphite may be excessively crystallized in a hyper-eutectic composition to cause shrinkage defects and degrade fluidity. Thus, the amount of carbon (C) may be within a range from about 3.0 wt % to about 3.4 wt % so that the tensile strength at the room temperature and the high temperature may be maintained, and the spheroidal graphite cast iron having improved fluidity without shrinkage defects may be achieved.

2) Silicon (Si) in a Range from about 4.2 wt % to about 4.5 wt %

Silicon (Si) may be an alloy element for improving high temperature strength and oxidation-resistive property. If an amount of silicon (Si) in the spheroidal graphite cast iron according to example embodiments is less than about 4.2 wt %, the high temperature strength and oxidation-resistive property may be deteriorated. If the amount of silicon (Si) exceeds about 4.5 wt %, a chunky graphite may be excessively crystallized to degrade a room temperature tensile strength and fluidity. More particularly, if the amount of silicon (Si) is greater than about 4.2 wt %, a fine $Fe_2SiO_4$ layer may be formed in a FeO oxidized layer to reduce an oxidation. Thus, when silicon (Si) is added in a range from about 4.2 wt % to about 4.5 wt %, a catalytic attack by a high temperature oxidized layer may be alleviated.

3) Manganese (Mn) in a Range from about 0.1 wt % to about 0.3 wt %

Manganese (Mn) may be a representative pearlite inducing element, and may react with sulfur (S) to facilitate creating of a graphite nucleation site. In the spheroidal graphite cast iron according to example embodiments, if an amount of manganese (Mn) is less than about 0.1 wt %, the number of nucleation sites may be reduced to cause a coarse spheroidal graphite or a chill phenomenon. If the amount of manganese (Mn) exceeds about 0.3 wt %, pearlite may be generated in a matrix, a high temperature strength may be reduced and a weak oxidized layer may be formed. Thus, the amount of Manganese (Mn) may be preferably in a range from about 0.1 wt % to about 0.3 wt %.

4) Sulfur (S) in a Range from about 0.002 wt % to about 0.01 wt %

Sulfur (S) may be an inhibiting element of a graphite spherodizing, and thus an amount of sulfur may be preferably reduced for achieving a robust spheroidal graphite cast iron. However, a trace amount of sulfur (S) may assist in generating a graphite nucleation site by reacting with manganese (Mn). In the spheroidal graphite cast iron according to example embodiments, if an amount of sulfur (S) is less than about 0.002 wt %, the number of the nucleation sites and spheroidal graphite in a unit area may be reduced to cause a coarse formation of the spheroidal graphite. If the amount of sulfur (S) exceeds about 0.01 wt %, the spheroidal graphite may not be achieved and a flake graphite may be formed. Thus, the amount of sulfur (S) may be adjusted in a range from about 0.002 wt % to about 0.01 wt %.

5) Phosphorous (P) Less than about 0.05 wt %

Phosphorous may be a naturally added impurity while performing a cast iron process in an air. Phosphorous (P) may react with a trace element included in a molten metal to form a phosphide (steadite) to strengthen a matrix and improve an anti-wearing property. However, if an amount of phosphorous (P) exceeds about 0.05 wt %, pearlite may be stabilized and a brittleness may be drastically increased. Thus, the amount of phosphorous may be preferably less than about 0.05 wt %. A lower limit of phosphorous (P) may exceed about 0 wt %, and may not be limited to a specific value.

6) Magnesium (Mg) in a Range from about 0.035 wt % to about 0.055 wt %

Magnesium (Mg) may react with sulfur (S) and oxygen (0) which may be spherodizing inhibition elements to remove S and 0 in a molten metal by forming MgS and MgO so that a crystallization of a spheroidal graphite may be facilitated. In the spheroidal graphite cast iron according to example embodiments, if an amount of magnesium (Mg) is less than about 0.035 wt %, a crystallization of a flake graphite may be caused. If the amount of magnesium (Mg) exceeds about 0.055 wt %, a chill phenomenon may be caused, and a brittleness may be increased. Thus, the amount of magnesium (Mg) may be preferably in a range from about 0.035 wt % to about 0.055 wt %.

7) Molybdenum (Mo) in a Range from about 0.9 wt % to about 1.2 wt %

Molybdenum (Mo) may strengthen a matrix of the spheroidal graphite cast iron, and thus improve a high temperature strength. In the spheroidal graphite cast iron according to example embodiments, if an amount of molybdenum (Mo) is less than about 0.9 wt %, a sufficient high temperature tensile strength may not be achieved. If an amount of molybdenum exceeds about 1.2 wt %, the high temperature strength may be slightly increased due to an enhanced matrix structure. However, a material cost may be increased to degrade a productivity due to a small increasing rate of the high temperature tensile strength per an addition of molybdenum (Mo). Thus, the amount of molybdenum (Mo) may be preferably in a range from about 0.9 wt % to about 1.2 wt %.

8) Nickel (Ni) in a Range from about 0.2 wt % to about 0.5 wt %

Nickel (Ni) may be a refining element of the spheroidal graphite cast iron, and may easily form a solid solution with austenite and ferrite to strengthen a matrix. Further, nickel (Ni) may be an austenite stabilizing element, and may have an improved thermal shock property in a phase transition at a high temperature. In the spheroidal graphite cast iron according to example embodiments, if an amount of nickel (Ni) is less than about 0.2 wt %, a sufficient austenite stabilization may not be achieved to deteriorate a high temperature oxidation-resistive property. If the amount of nickel (Ni) exceeds about 0.5 wt %, austenite stabilizing, thermal shock and high temperature oxidation-resistive properties may be commonly improved. However, a material cost may be excessively increased. Thus, the amount of nickel (Ni) may be in a range from about 0.2 wt % to about 0.5 wt %.

9) Vanadium (V) in a Range from about 0.4 wt % to about 0.6 wt %

Vanadium (V) may improve a strength from a room temperature to a high temperature at about 850° C. Vanadium (V) may create a fine vanadium carbide (VC) having a high melting point in a ferrite matrix to improve a high temperature strength. In the spheroidal graphite cast iron according to example embodiments, if an amount of vanadium (V) is less than about 0.4 wt %, a fraction of vanadium carbide (VC) may become small. Thus, sufficient high temperature strength and oxidation-resistive property may not be achieved. If the amount of vanadium (V) exceeds about 0.6 wt %, a coarse vanadium carbide may be segregated between process cells to increase a hardness and degrade a workability without improving the high temperature strength. Thus, the amount of vanadium (V) may be in a range from about 0.4 wt % to about 0.6 wt %.

10) Niobium (Nb) in a Range from about 0.1 wt % to about 0.4 wt %

Niobium (Nb) may refine a grain, and improve mechanical properties such as a tensile strength, an impact strength, etc. Specifically, niobium (Nb) may have a good affinity to carbon or nitrogen to induce a precipitation of carbide such as niobium carbide in a cast iron, and may suppress a phase transition of ostenite and ferrite. In the spheroidal graphite cast iron according to example embodiments, if an amount of niobium (Nb) is less than about 0.1 wt %, a sufficient precipitation hardening by niobium carbide may not occur. If an amount of niobium (Nb) exceeds about 0.4 wt %, niobium carbide may be segregated between process cells to increase a hardness and degrade a workability while decreasing a high temperature strength and oxidation-resistive property. Thus, the amount of niobium (Nb) may be preferably in a range from about 0.1 wt % to about 0.4 wt %.

11) Aluminum (Al) in a Range from about 0.003 wt % to about 0.007 wt %

Aluminum (Al) may have a good oxidation-resistive property. When a trace amount of aluminum (Al) is added to a cast iron, it may facilitate a nucleation site and improve fluidity. However, when aluminum (Al) is excessively added, it may react with a moisture included in a mold, a core, a moldwash, etc., to cause a pin hole failure. In the spheroidal graphite cast iron according to example embodiments, if an amount of aluminum (Al) is less than about 0.003 wt %, sufficient nucleation sites and fluidity may not be achieved. If the amount of aluminum (Al) exceeds about 0.007 wt %, the pin hole failure may be caused. Thus, the amount of aluminum (Al) may be preferably in a range from about 0.003 wt % to about 0.007 wt %.

12) Cerium (Ce) in a Range from about 0.005 wt % to about 0.01 wt %

Cerium (Ce) may react with sulfur (S) to form cerium sulfide (CeS) to strongly create graphite nucleation sites and facilitate a growth of a spheroidal graphite. In the spheroidal graphite cast iron according to example embodiments, if an amount of cerium (Ce) is less than about 0.005 wt %, the nucleation sites and the spheroidal graphite may not be sufficiently created. If the amount of cerium (Ce) exceeds about 0.01 wt %, a primary graphite may be excessively crystallized to cause a chunky graphite and shrinkage defects, and degrade fluidity. Thus, the amount of aluminum (Ce) may be preferably in a range from about 0.005 wt % to about 0.01 wt %.

13) Iron (Fe)

Iron (Fe) may be a main material of the cast iron according to example embodiments. A remaining component except for the ingredients as mentioned above may be iron (Fe), and native impurities may be also included.

Hereinafter, the present inventive concepts will be described with reference to Examples and Comparative Examples. However, the scope of the present inventive concepts is not limited to Examples, and various modifications are possible without departing from the spirit of the present inventive concepts.

Spheroidal graphite cast irons of Examples 1 to 8 (Ex. 1 to 8), and Comparative

Examples 1 to 8 (C.E. 1 to 8) were prepared based on compositions listed in Table 1 below.

TABLE 1

| | C | Si | Mn | S | P | Mg | Mo | V | Nb | Ni | Al | Ce | Ni/Al |
|---|---|---|---|---|---|---|---|---|---|---|---|---|---|
| Ex. 1 | 3.311 | 4.246 | 0.212 | 0.004 | 0.039 | 0.039 | 0.947 | 0.494 | 0.350 | 0.313 | 0.0041 | 0.0095 | 76.34 |
| Ex. 2 | 3.290 | 4.415 | 0.206 | 0.008 | 0.038 | 0.051 | 0.911 | 0.540 | 0.301 | 0.300 | 0.0055 | 0.0091 | 54.54 |

TABLE 1-continued

| | C | Si | Mn | S | P | Mg | Mo | V | Nb | Ni | Al | Ce | Ni/Al |
|---|---|---|---|---|---|---|---|---|---|---|---|---|---|
| Ex. 3 | 3.357 | 4.491 | 0.204 | 0.006 | 0.038 | 0.046 | 0.956 | 0.485 | 0.338 | 0.330 | 0.0067 | 0.0055 | 49.25 |
| Ex. 4 | 3.383 | 4.338 | 0.291 | 0.002 | 0.040 | 0.054 | 1.172 | 0.410 | 0.118 | 0.483 | 0.0035 | 0.0075 | 138.00 |
| Ex. 5 | 3.219 | 4.374 | 0.189 | 0.009 | 0.041 | 0.042 | 0.984 | 0.524 | 0.248 | 0.498 | 0.0030 | 0.0089 | 166 |
| Ex. 6 | 3.091 | 4.293 | 0.202 | 0.004 | 0.029 | 0.051 | 0.995 | 0.591 | 0.391 | 0.258 | 0.0065 | 0.0088 | 39.69 |
| Ex. 7 | 3.195 | 4.405 | 0.288 | 0.003 | 0.046 | 0.035 | 1.092 | 0.584 | 0.299 | 0.203 | 0.0070 | 0.0090 | 29.00 |
| Ex. 8 | 3.272 | 4.315 | 0.260 | 0.006 | 0.041 | 0.045 | 0.962 | 0.441 | 0.310 | 0.432 | 0.0041 | 0.0076 | 105.36 |
| C.E. 1 | 3.327 | 4.294 | 0.288 | 0.007 | 0.039 | 0.042 | 1.102 | 0.512 | 0.307 | 0.188 | 0.0067 | 0.0069 | 28.05 |
| C.E. 2 | 3.225 | 4.310 | 0.194 | 0.005 | 0.031 | 0.037 | 0.998 | 0.483 | 0.299 | 0.610 | 0.0036 | 0.0061 | 169.44 |
| C.E. 3 | 3.311 | 4.452 | 0.254 | 0.007 | 0.046 | 0.045 | 0.971 | 0.483 | 0.302 | 0.337 | — | 0.0073 | — |
| C.E. 4 | 3.472 | 3.99 | 0.224 | 0.008 | 0.032 | 0.041 | 1.082 | — | — | — | — | — | — |
| C.E. 5 | 3.251 | 4.724 | 0.237 | 0.013 | 0.037 | 0.038 | 1.294 | 0.87 | — | 0.547 | — | — | — |
| C.E. 6 | 3.166 | 4.282 | 0.209 | 0.008 | 0.038 | 0.041 | 0.943 | — | 0.312 | 0.298 | — | — | — |
| C.E. 7 | 2.982 | 4.295 | 0.377 | 0.007 | 0.041 | 0.055 | 0.921 | — | — | 0.612 | — | — | — |
| C.E. 8 | 3.59 | 4.291 | 0.802 | 0.009 | 0.049 | 0.071 | 0.699 | 0.597 | — | — | — | — | — |

According to the compositions of Table 1, an original molten metal containing carbon (C), silicon (Si), manganese (Mn), sulfur (S) and phosphorous (P) was prepared. Phosphorous (P) was not added individually, but included as an impurity in an original material for casting. An amount of phosphorous was controlled below about 0.05 wt %.

Before tapping the molten metal, contents of alloy elements including silicon (Si), molybdenum (Mo), manganese (Mn), nickel (Ni), vanadium (V), niobium (Nb), etc., were adjusted using a spectrometer. Aluminum (Al) and cerium (Ce) were added to complete a melting, and then a tapping was performed. A first inoculation was performed concurrently with the tapping using a Fe—Si-based inoculant. The tapping was finished into a ladle, a temperature of a molten metal was measured, and the molten metal was injected into a mold. A second inoculation was performed concurrently with the injection using a Fe—Si-based inoculant to achieve spheroidal graphite cast irons as shown in Table 1 having improved high temperature oxidation-resistive property and fluidity.

A room temperature tensile strength, a high temperature tensile strength, a thickness of an oxidized layer and a fluidity of each of Examples 1 to 8, and Comparative Examples 1 to 8 listed in Table 1 were measured, and the results are shown in Table 2 below.

Figure 2:
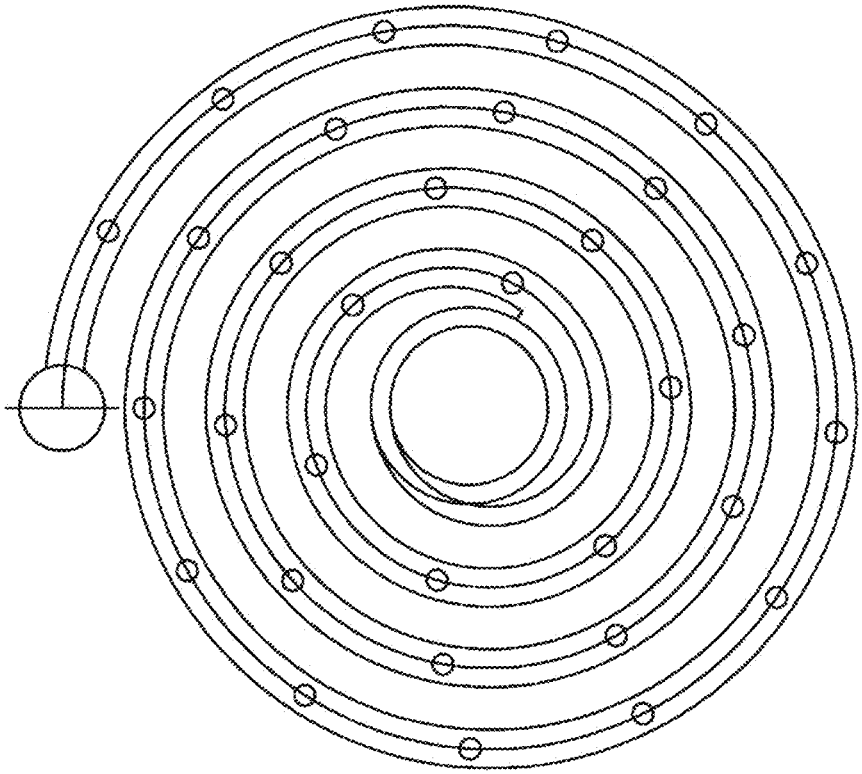
FIG. 2 is a plan view illustrating a helical specimen for evaluating a fluidity.

The fluidities of the spheroidal graphite cast irons according to Examples 1 to 8, and Comparative Examples 1 to 8 were evaluated using a helical specimen illustrated in FIG. 2.

Figure 3:
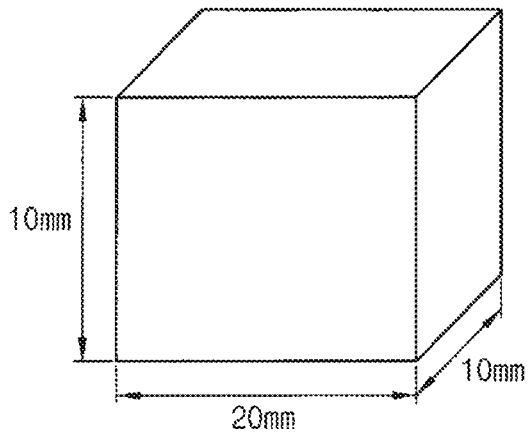
FIG. 3 is a perspective view illustrating a specimen for evaluating a high temperature oxidation-resistive property.
Figure 4:
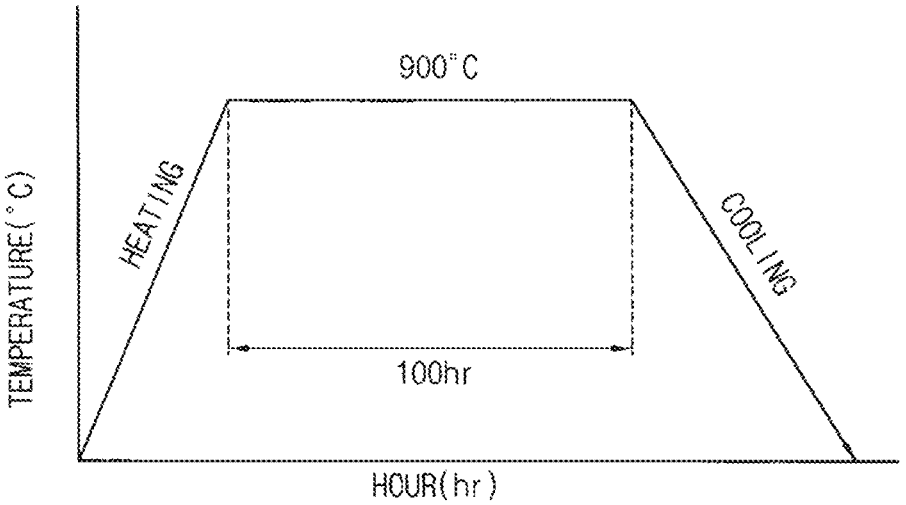
FIG. 4 is a graph showing a test condition for evaluating a high temperature oxidation-resistive property.

High temperature oxidation-resistive properties of the spheroidal graphite cast irons according to Examples 1 to 8, and Comparative Examples 1 to 8 were evaluated using a specimen illustrated in FIG. 3 and using conditions illustrated in FIG. 4.

Figure 5:
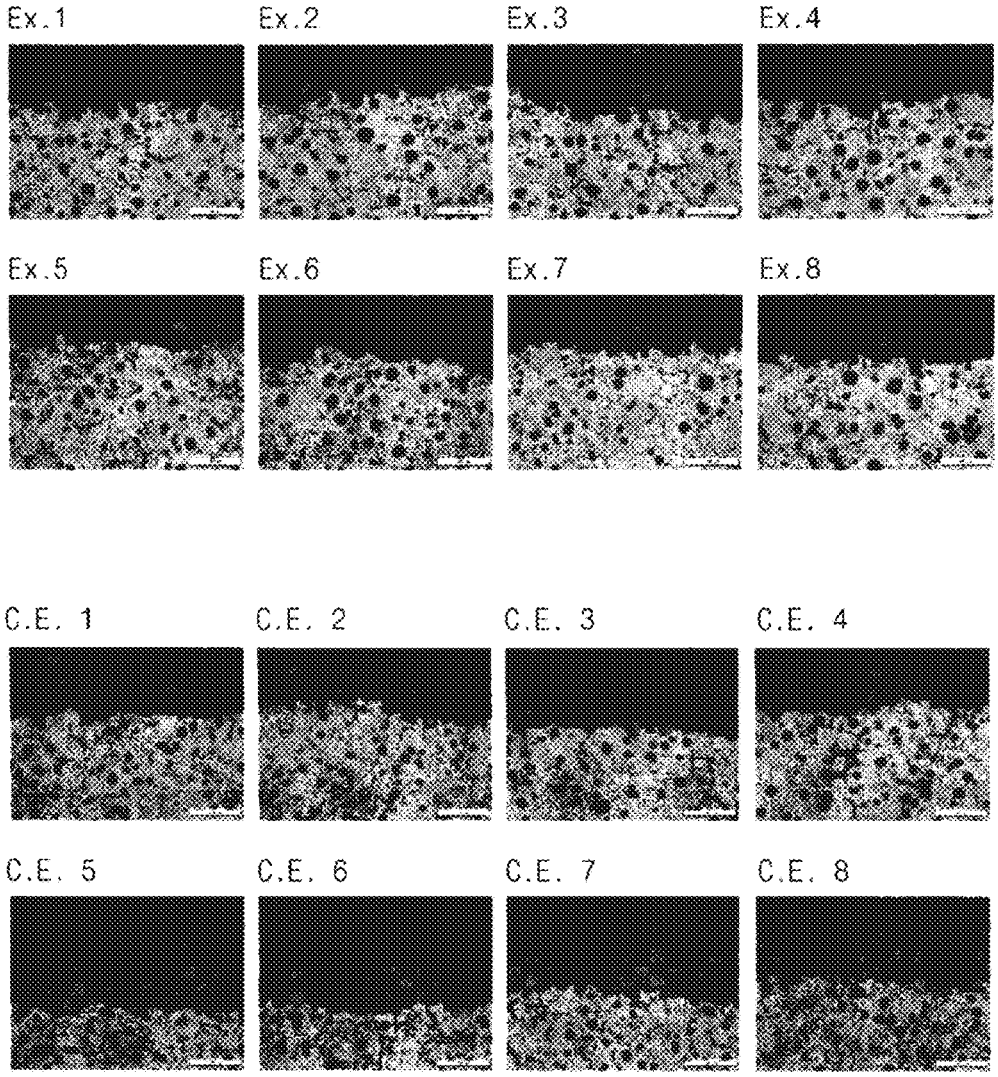
FIG. 5 shows images of spheroidal graphite cast irons and oxidized layers formed on surfaces thereof in Examples 1 to 8 and Comparative Examples 1 to 8.

FIG. 5 shows images of spheroidal graphite cast irons and oxidized layers formed on surfaces thereof in Examples 1 to 8 and Comparative Examples 1 to 8.

TABLE 2

| | Thickness of Oxidized Layer (μm) | Fluidity (mm) | High Temperature (800° C.) Tensile Strength (MPa) |
|---|---|---|---|
| Ex. 1 | 185 | 790 | 57 |
| Ex. 2 | 123 | 764 | 58 |
| Ex. 3 | 174 | 788 | 57 |
| Ex. 4 | 166 | 759 | 55 |
| Ex. 5 | 147 | 792 | 52 |
| Ex. 6 | 162 | 775 | 55 |
| Ex. 7 | 159 | 769 | 53 |

TABLE 2-continued

| | Thickness of Oxidized Layer (μm) | Fluidity (mm) | High Temperature (800° C.) Tensile Strength (MPa) |
|---|---|---|---|
| Ex. 8 | 188 | 781 | 58 |
| C.E. 1 | 222 | 742 | 50 |
| C.E. 2 | 209 | 722 | 53 |
| C.E. 3 | 207 | 699 | 47 |
| C.E. 4 | 210 | 748 | 41 |
| C.E. 5 | 381 | 695 | 52 |
| C.E. 6 | 361 | 727 | 54 |
| C.E. 7 | 319 | 740 | 49 |
| C.E. 8 | 302 | 739 | 49 |

As shown in Table 2, in the cast irons of Examples 1 to 8 in which Ni/Al ratios were adjusted within from about 29 to about 166, the thicknesses of the oxidized layers were below 190 μm, helix lengths of the specimen for evaluating the fluidity were greater than 750 mm Further, the high temperature tensile strengths measured at 800° C. were greater than 50 MPa.

In Comparative Examples 1 and 2, alloy elements were the same as those of Examples 1 to 8. However, the amount of Ni and the Ni/Al ratio were not in the ranges according to example embodiments of the present inventive concepts.

In Comparative Example 3, alloy elements were the same as those of Examples 1 to 8, however, aluminum (Al) included in the present inventive concepts was excluded.

In Comparative Example 4, alloy elements of a heat-resistant spheroidal graphite cast iron applied to an engine exhaust manifold having a combustion temperature below 800° C. were only added.

In Comparative Examples 5 to 8, conventional compositions for manufacturing a spheroidal graphite cast iron used in an engine exhaust system component having a combustion temperature greater than about 800° C. were prepared.

In Comparative Examples 1, 2, 5 and 6, the high temperature tensile strengths (at 800° C.) satisfied a target value required in the present inventive concepts. However, target values of other categories were not achieved.

In Comparative Examples 3, 4, 7 and 8, target values of all categories were not achieved.

Specifically, in Comparative Example 3 devoid of aluminum, a low fluidity was measured. In Comparative Example 1 in which aluminum was excessively added relatively to nickel, a large thickness of the oxidized layer and a low fluidity were caused compared to the present inventive concepts.

As a result, the spheroidal graphite cast iron having improved high temperature oxidation-resistive property and fluidity according to the present inventive concepts may also have improved high temperature tensile strength and stabilized oxidized layer. Thus, the spheroidal graphite cast iron may be effectively implemented to an engine exhaust system component having a combustion temperature greater than about 800° C.

Figure 6:
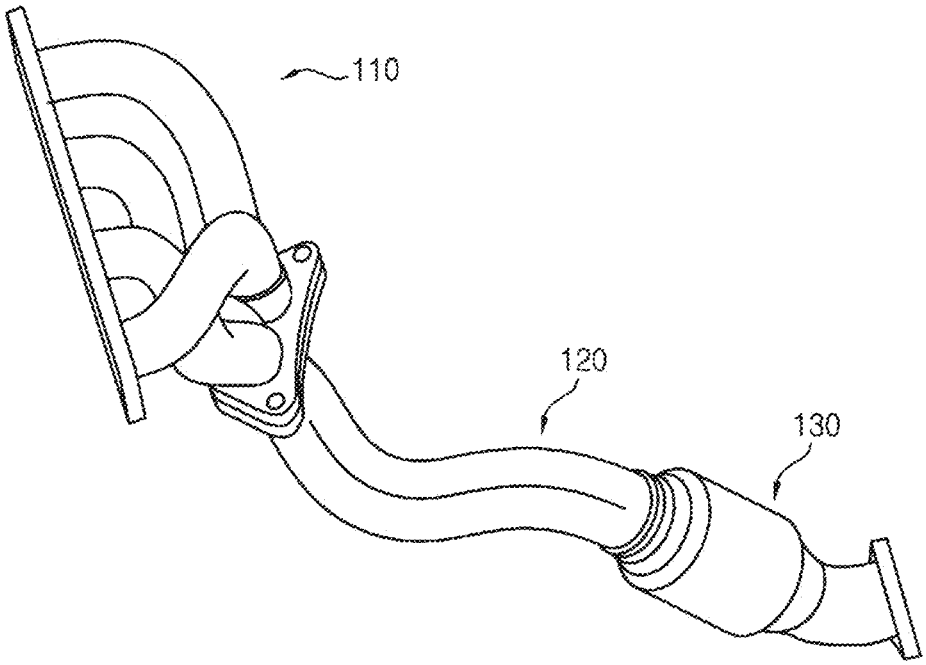
FIG. 6 illustrates an engine exhaust system component including a spheroidal graphite cast iron in accordance with example embodiments.

Referring to FIG. 6, the engine exhaust system component may include a exhaust manifold 110 individually connected to an exhaust port (not illustrated) of a combustion chamber per each cylinder, a front pipe 120 coupled to an one end of the exhaust manifold 110, and a vibration damper 130 located at an outer periphery of the front pipe 120 and absorbing a vibration due to a shock wave during an exhaustion.

Particularly, the exhaust manifold 110 may contact a high temperature exhaust gas generated in the combustion chamber, and thus may be required to have an improved heat-resistance. According to example embodiments, the exhaust manifold 110 may include the spheroidal graphite cast iron of the present inventive concepts.

What is claimed is:

1. A spheroidal graphite cast iron for a component of an engine exhaust system, comprising:

carbon (C) in a range from 3.0 weight percent to 3.4 weight percent, silicon (Si) in a range from 4.2 weight percent to 4.5 weight percent, manganese (Mn) in a range from 0.1 weight percent to 0.3 weight percent, sulfur (S) in a range from 0.002 weight percent to 0.01 weight percent, phosphorous (P) in a range equal to or less than 0.05 weight percent, magnesium (Mg) in a range from 0.035 weight percent to 0.055 weight percent, molybdenum (Mo) in a range from 0.9 weight percent to 1.2 weight percent, vanadium (V) in a range from 0.4 weight percent to 0.6 weight percent, niobium (Nb) in a range from 0.1 weight percent to 0.4 weight percent, nickel (Ni) in a range from 0.2 weight percent to 0.5 weight percent, aluminum (Al) in a range from 0.003 weight percent to 0.007 weight percent, and a remainder of iron (Fe), based on a total weight of the spheroidal graphite cast iron, wherein a content ratio of the nickel and the aluminum (Ni/Al) is in a range from 29 to 166.

2. The spheroidal graphite cast iron of claim 1, further comprising cerium (Ce) in a range from 0.005 weight percent to 0.01 weight percent.

3. The spheroidal graphite cast iron of claim 1, wherein a surface oxidized layer of the spheroidal graphite cast iron has a thickness less than 190 μm when thermally treated at a temperature below 900° C.

4. The spheroidal graphite cast iron of claim 3, wherein the surface oxidized layer includes $Fe_2SiO_4$.

5. The spheroidal graphite cast iron of claim 1, wherein a helical specimen is provided to evaluate a fluidity of the spherodial graphite cast iron and a helix length of the helical specimen is greater than 750 mm.

6. The spheroidal graphite cast iron of claim 1, wherein a high temperature tensile strength of the spheroidal graphite cast iron at 800° C. is greater than 50 MPa.

7. The spheroidal graphite cast iron of claim 1, wherein the component of the engine exhaust system includes an exhaust manifold.

8. A component of an engine exhaust system comprising an engine exhaust manifold that includes the spheroidal graphite cast iron of claim 1.

9. The component of the engine exhaust system of claim 8, wherein the spheroidal graphite cast iron includes a surface oxidized layer, the surface oxidized layer having a thickness less than 190 μm and including Fe2SiO4.

* * * * *